US008610042B2

(12) United States Patent
Sankovic

(10) Patent No.: US 8,610,042 B2
(45) Date of Patent: Dec. 17, 2013

(54) PYROTECHNIC FIN DEPLOYMENT AND RETENTION MECHANISM

(75) Inventor: John R. Sankovic, Chesterland, OH (US)

(73) Assignee: Simmonds Precision Products, Inc., Vergennes, VT (US)

( * ) Notice: Subject to any disclaimer, the term of this patent is extended or adjusted under 35 U.S.C. 154(b) by 618 days.

(21) Appl. No.: 12/927,275

(22) Filed: Nov. 10, 2010

(65) Prior Publication Data

US 2011/0186678 A1 Aug. 4, 2011

Related U.S. Application Data

(62) Division of application No. 12/012,998, filed on Feb. 7, 2008, now Pat. No. 8,338,769.

(51) Int. Cl.
*F42B 10/14* (2006.01)
*B64C 3/56* (2006.01)

(52) U.S. Cl.
USPC ..... 244/3.24; 244/49

(58) Field of Classification Search
USPC ..... 244/3.24, 3.27, 3.28, 3.29, 49; 102/385, 102/490
See application file for complete search history.

(56) References Cited

U.S. PATENT DOCUMENTS 3,196,793 A * 7/1965 Milenkovic et al. ..... 244/3.28
3,918,664 A * 11/1975 Grosswendt ..... 244/3.28
3,944,168 A * 3/1976 Bizien et al. ..... 244/3.28
3,946,969 A * 3/1976 Marburger et al. ..... 244/3.28
4,175,720 A * 11/1979 Craig ..... 244/3.28
4,600,167 A * 7/1986 Kastenhuber et al. ..... 244/3.28
4,624,424 A * 11/1986 Pinson ..... 244/3.21
4,778,127 A * 10/1988 Duchesneau ..... 244/3.29
4,884,766 A * 12/1989 Steinmetz et al. ..... 244/3.27
5,072,891 A * 12/1991 Cavalleri et al. ..... 244/3.21
5,082,203 A * 1/1992 Baubry ..... 244/3.28
5,114,095 A * 5/1992 Schroppel et al. ..... 244/3.28
5,950,963 A * 9/1999 Speicher et al. ..... 244/3.21
6,073,880 A * 6/2000 Voigt et al. ..... 244/3.28
6,446,906 B1 * 9/2002 Voigt et al. ..... 244/3.27
6,450,444 B1 * 9/2002 Sorvino ..... 244/3.24
6,502,786 B2 * 1/2003 Rupert et al. ..... 244/3.27
6,695,252 B1 * 2/2004 Dryer ..... 244/3.28
6,880,780 B1 * 4/2005 Perry et al. ..... 244/3.27

(Continued)

FOREIGN PATENT DOCUMENTS

DE 3917653 A1 * 12/1990
DE 4017504 A1 * 7/1993
EP 354088 A1 * 2/1990
JP 01067598 A * 3/1989

*Primary Examiner* — Joseph W Sanderson
(74) *Attorney, Agent, or Firm* — Cantor Colburn LLP

(57) ABSTRACT

A fin retention and deployment mechanism includes a detent in each of a plurality of fins, a mechanism that engages the detent, and at least one spring clip that maintains each of the fins in a non-deployed position. The mechanism also includes a gas generator, a manifold, coupled to the gas generator and having a plurality of cylinders in fluid communication with gas from the gas generator, and a plurality of pistons disposed in the cylinders. A bottom of each of the pistons is coupled to each of the fins to provide deployment thereof when a corresponding top of each of the pistons is acted upon by gas from the gas generator. In response to the gas generator expelling gas, the pistons may move the fins to a deployed position.

4 Claims, 8 Drawing Sheets

(56) References Cited

U.S. PATENT DOCUMENTS

| | | | | |
|---|---|---|---|---|
| 6,948,685 | B2 * | 9/2005 | Hawthorne | 244/129.1 |
| 7,083,140 | B1 * | 8/2006 | Dooley | 244/3.27 |
| 7,195,197 | B2 * | 3/2007 | Hsu et al. | 244/3.27 |
| 7,316,370 | B2 * | 1/2008 | Sankovic et al. | 244/3.27 |
| 8,183,508 | B1 * | 5/2012 | Sankovic | 244/3.27 |
| 8,324,545 | B2 * | 12/2012 | Ashkenazi | 244/3.27 |
| 8,338,769 | B1 * | 12/2012 | Sankovic | 244/3.27 |
| 8,378,278 | B2 * | 2/2013 | Ashkenazi | 244/3.27 |
| 2005/0103926 | A1 * | 5/2005 | Hawthorne | 244/3.27 |
| 2006/0213191 | A1 * | 9/2006 | Borg et al. | 60/512 |
| 2008/0001023 | A1 * | 1/2008 | Schroeder | 244/3.24 |
| 2010/0314488 | A1 * | 12/2010 | Ashkenazi | 244/3.27 |

* cited by examiner

PYROTECHNIC FIN DEPLOYMENT AND RETENTION MECHANISM

RELATED APPLICATIONS

This application is a divisional of U.S. application Ser. No. 12/012,998 filed Feb. 7, 2008 now U.S. Pat. No. 8,338,769, which is hereby incorporated by reference.

STATEMENT OF GOVERNMENT SUPPORT

This invention was made with U.S. government support under Contract Number FA8681-06-C-0152. The U.S. government may have certain rights in the invention.

BACKGROUND OF THE INVENTION

1. Technical Field

This application relates to the field of fin deployment and retention, and more particularly to the field of fin deployment and retention for projectiles that are guided by fins.

2. Description of Related Art

Projectiles that are guided by fins, such as bombs dropped from aircraft, missiles, etc., may need to be stored in a relatively compact manner prior to deployment. However, the fins on the projectiles may limit the number of projectiles that may be stored in a given space. In addition, storage and transport of projectiles having fins may result in damage to the fins due to movement that can be expected in the course of transportation.

One way to address these issues is to manually detach the fins prior to deployment and then reattach the fins just prior to use. However, this may be impractical for a number of reasons. Manual reattachment may not be possible in situations when projectiles are being stored and then deployed in an automated fashion. For example, it may be desirable to store the projectiles in an aircraft bomb compartment that is opened while the aircraft is in flight.

As an alternative to manual fin deployment, the fins may be folded close to the body of the projectile for storage and transport and then automatically deployed just prior to use. However, for such a system, it is important that all of the fins be reliably deployed for the projectile to operate properly. In addition, it is also useful to avoid premature deployment (e.g., from jostling the aircraft) since premature deployment may cause the fins to be damaged and/or adversely affect deployment of the projectiles altogether.

Accordingly, it is desirable to provide a system that addresses the needs set forth above.

SUMMARY OF THE INVENTION

According to the system described herein, a fin deployment mechanism includes a gas generator, a manifold, coupled to the gas generator and having a plurality of cylinders in fluid communication with gas from the gas generator, and a plurality of pistons disposed in the cylinders, a bottom of each of the pistons being coupled to a fin to provide deployment thereof when a corresponding top of each of the pistons is acted upon by gas from the gas generator. The fin deployment mechanism may also include a valve coupled to the gas generator to control a flow of gas therefrom. The gas generator may be implemented using a chemical initiator. The fin deployment mechanism may also include a plurality of springs, disposed in the cylinders, to bias the pistons away from the fins. The pistons may be directly coupled to the fins or may be coupled to the fins through a padding element. The padding element may be made from a material that is softer than a material used for the fins. The fins may be made from 7075-T6 aluminum while the padding element 68 may be made from 6061-T6 aluminum.

According further to the system described herein, a fin retention mechanism includes a first detent in a fin, a mechanism that engages the first detent, and at least one spring clip that maintains the fin in a non-deployed position. The fin retention mechanism may also include a second detent that engages the mechanism. The fin may be maintained in a non-deployed position in response to the first detent engaging with the mechanism. The fin may be maintained in a deployed position in response to the second detent engaging with the mechanism and release of the fin from the spring clip. The mechanism that engages the first detent may include a ball and a spring that urges the ball toward the first detent. The mechanism that engages the first detent may include a plunger and a spring that urges the plunger toward the first detent.

According further to the system described herein, a fin retention and deployment mechanism includes a first detent in each of a plurality of fins, a mechanism that engages the first detent, at least one spring clip that maintains each of the fins in a non-deployed position, a gas generator, a manifold, coupled to the gas generator and having a plurality of cylinders in fluid communication with gas from the gas generator, and a plurality of pistons disposed in the cylinders, a bottom of each of the pistons being coupled to each of the fins to provide deployment thereof when a corresponding top of each of the pistons is acted upon by gas from the gas generator. The fin retention and deployment mechanism may also include a plurality of springs, disposed in the cylinders, to bias the pistons away from the fins. The pistons may be coupled to the fins through a padding element that is made from a material that is softer than a material used for the fins. In response to the gas generator expelling gas, the pistons may move the fins to a deployed position and a second detent in each of the fins may engage the mechanism to maintain the fins in a deployed position. The mechanism that engages the detents may include a ball and a spring that urges the ball toward the detents and/or may include a plunger and a spring that urges the plunger toward the detents.

BRIEF DESCRIPTION OF THE DRAWINGS

Embodiments of the system are described with reference to the several figures of the drawings, in which.

DETAILED DESCRIPTION OF VARIOUS EMBODIMENTS

Referring now to the figures of the drawings, the figures comprise a part of this specification and illustrate exemplary embodiments of the described system. It is to be understood that in some instances various aspects of the system may be shown schematically or may be exaggerated or altered to facilitate an understanding of the system.

Figure 1:
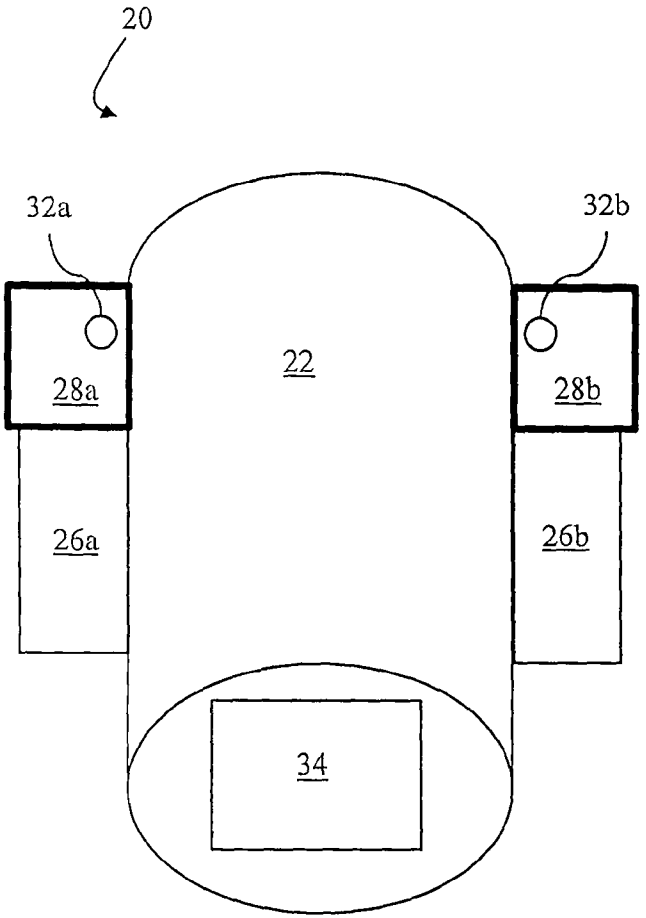
FIG. 1 is a schematic diagram of a fin assembly in which the fins are in a non-deployed position according to an embodiment of the system described herein.

Referring to FIG. 1, a control actuated fin assembly 20 is shown as including a base 22, a plurality of fins 26*a*, 26*b*, and a plurality of fin holders 28*a*, 28*b*. The fins 26*a*, 26*b* are shown in FIG. 1 in a folded, non-deployed, position. The system described herein allows for the fins 26*a*, 26*b* to be maintained in the non-deployed position to facilitate storage and/or transportation. The base 22 may represent a portion of a missile, a rocket, a torpedo, a flying drone, or similar device (projectile) that uses fins for navigation. Note that, although only the two fins 26*a*, 26*b* and the corresponding fin holders 28*a*, 28*b* are shown in FIG. 1, any number may be used. In an embodiment herein, the base 22 includes four fins, the two fins 26*a*, 26*b* shown in FIG. 1 and two additional fins not shown in 1 that are perpendicular to the view of FIG. 1. For the discussion herein, it should be assumed that, unless otherwise stated, reference to the two shown fins 26*a*, 26*b* include reference to all the fins being used.

The fin holders 28*a*, 28*b* include pins 32*a*, 32*b* that retain the fins 26*a*, 26*b* to the body 22. The pin 32*a* retains the fin 26*a* while the pin 32*b* retains the fin 26*b*. As described in more detail elsewhere herein, each of the fins 26*a*, 26*b* rotates about a corresponding one of the pins 32*a*, 32*b* to move the fins 26*a*, 26*b* into a deployed position. The base 22 also includes electronics 34 that are used in connection with deployment of the fins 26*a*, 26*b* and/or possibly actuation of the fins 26*a*, 26*b* for navigation of the projectile. The electronics 34 may receive one or more signals (e.g., transmitted radio frequency electronic signals, signals from a coupled tether, etc.) and may cause deployment of the fins 26*a*, 26*b* by providing one or more signals to electromechanical devices (not shown in FIG. 1), as described in more detail elsewhere herein.

Figure 2:
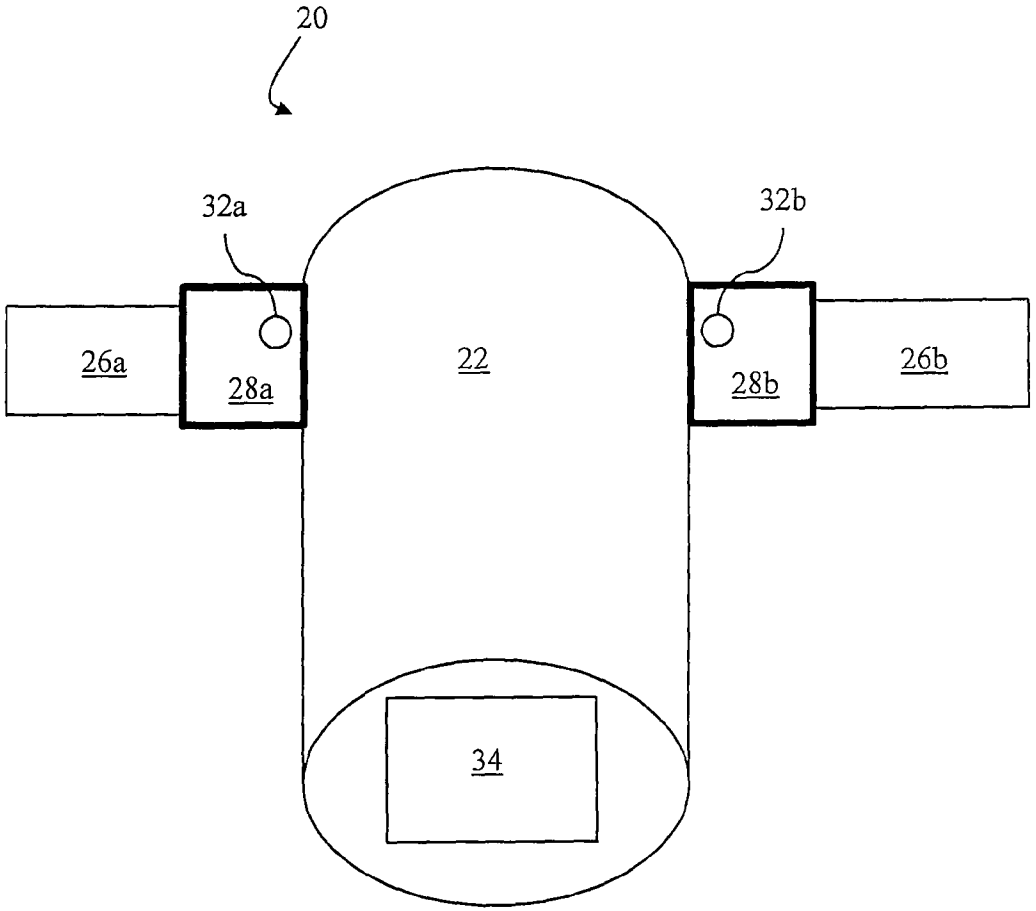
FIG. 2 is a schematic diagram of a fin assembly in which the fins are in a deployed position according to an embodiment of the system described herein.

Referring to FIG. 2, the assembly 20 is shown with the fins 26*a*, 26*b* deployed. As described in more detail elsewhere herein, an appropriate mechanism may be used to retain the fins 26*a*, 26*b* in a deployed position. In some embodiments, the mechanism may be provided in the fin holders 28*a*, 28*b*. In addition, in some embodiments, the mechanism that retains the fins 26*a*, 26*b* in a deployed position as shown in FIG. 2 may share at least some components with a mechanism that retains the fins 26*a*, 26*b* in a non-deployed position as shown in FIG. 1. In some embodiments, once the fins 26*a*, 26*b* are deployed, the fins 26*a*, 26*b* may be actuated (tilted) in a conventional manner using, for example, the electronics 34 and/or other electronic flight controls coupled to one or more electro-mechanical servos (not shown) that move the fins 26*a*, 26*b*.

Figure 3:
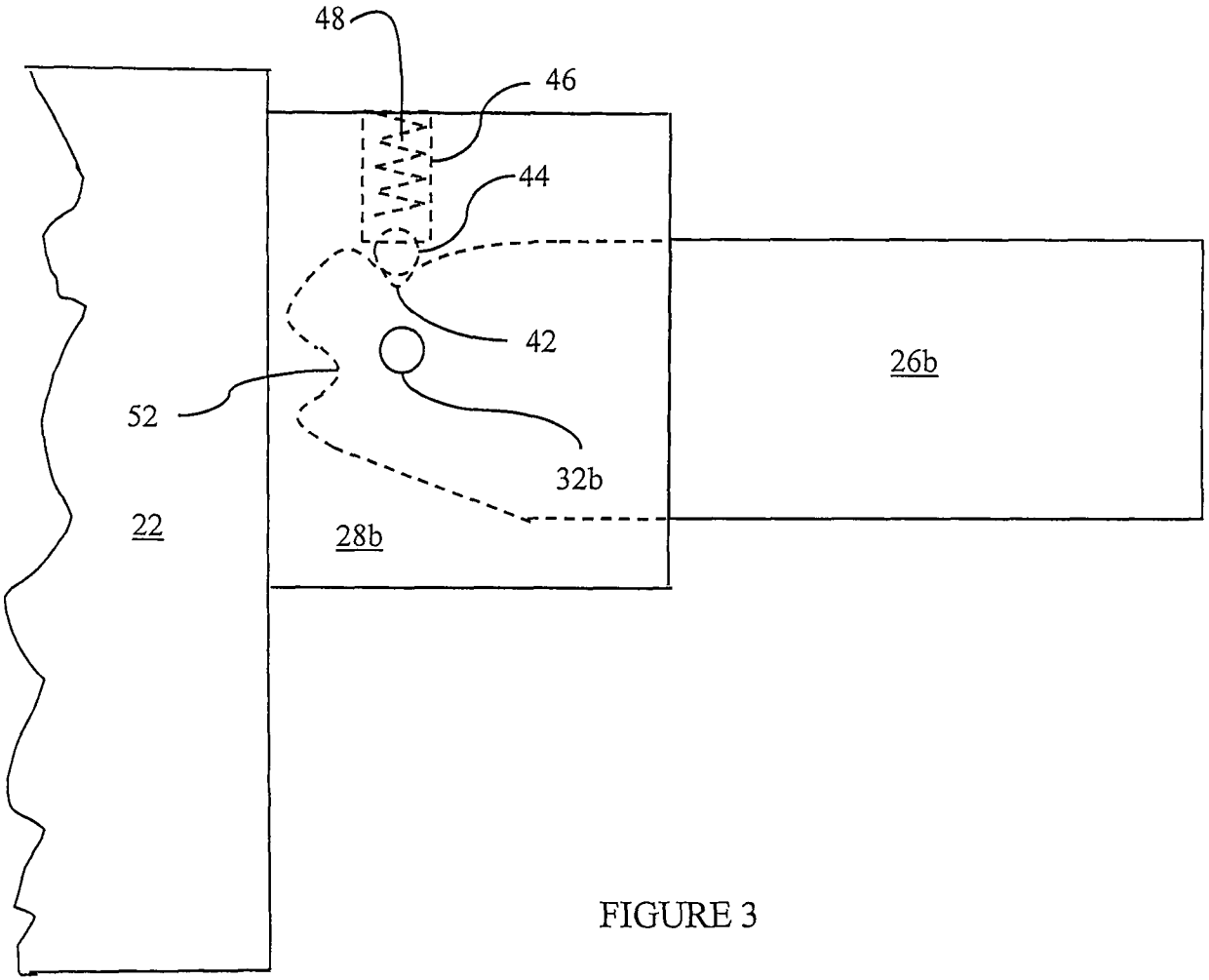
FIG. 3 is a schematic diagram showing a fin retention mechanism according to an embodiment of the system described herein.

Referring to FIG. 3, the fin 26*b* and the corresponding fin holder 28*b* are shown in more detail to illustrate a mechanism for retaining the fins 26*a*, 26*b* in a non-deployed position as shown in FIG. 1 and for maintaining the fins 26*a*, 26*b* in a deployed position as shown in FIG. 2. The fin 26*b* is shown as including a first detent 42 that accepts a ball 44 that is urged into the detent 42 by a spring 46. The ball 44 and the spring 46 may act as a retaining mechanism to retain the fin 26*b* in a deployed position.

The ball 44 and the spring 46 may be provided in a shaft 48 that is part of the fin holder 28*b*. In other embodiments, at least part of the shaft 48 may be part of the base 22. The shaft 48 may be cylindrical, although other shapes may also be used, including, without limitation, a shaft having a square, rectangular, oval, etc. cross section. In addition, instead of the ball 44, it may be possible to use other appropriate mechanisms, including using a plunger, as described in more detail elsewhere herein.

The fin 26*b* may also include a second detent 52 that engages the retaining mechanism formed by the ball 44 and the spring 46 when the fin 26*b* is in a non-deployed position as shown in FIG. 1. Just as with the deployed position, the spring 46 urges the ball 44 into the detent 52 to retain the fin 26*b* in a non-deployed position. Note also that other appropriate retaining mechanisms may be used in place of the ball 44 and the spring 46. Furthermore, as described in more detail elsewhere herein, additional retaining mechanisms may be used in conjunction with the mechanism that engages the detent 52.

Figure 4:
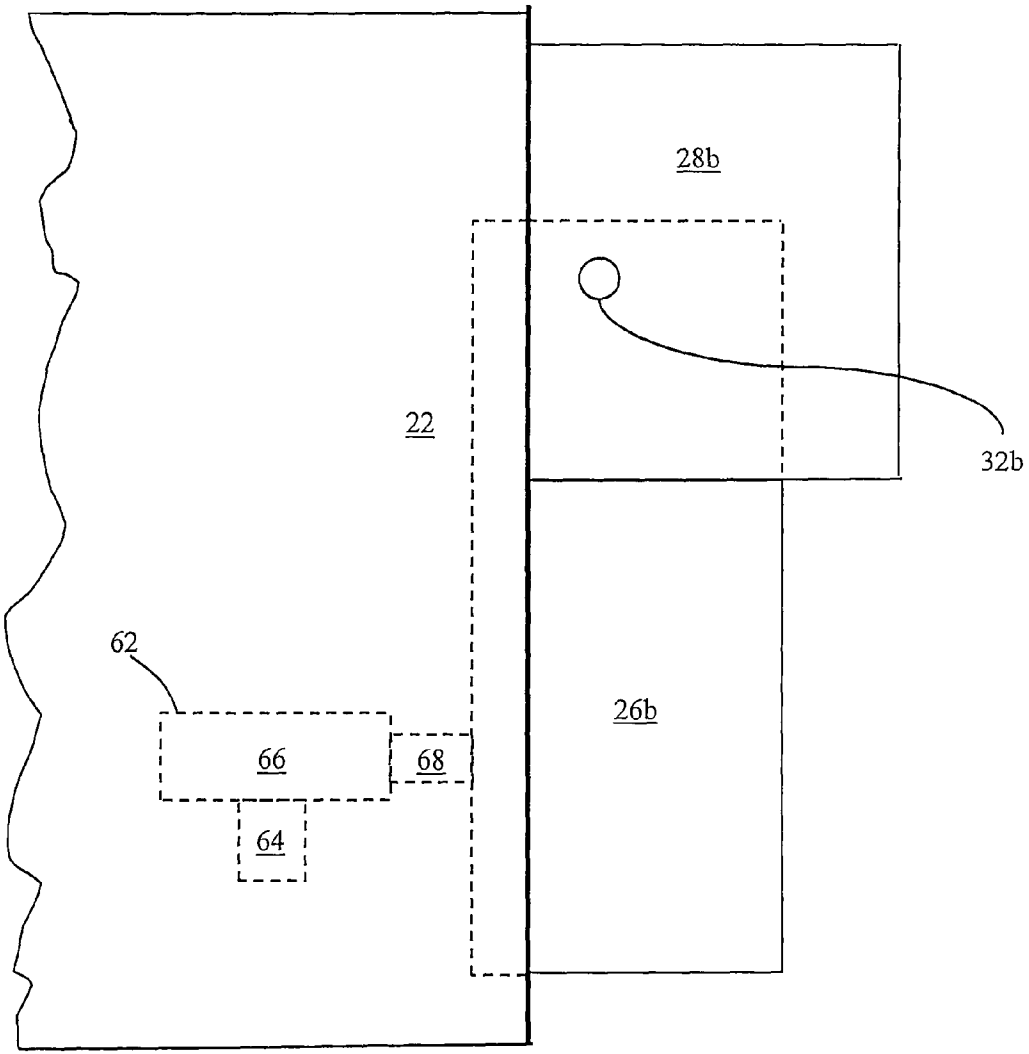
FIG. 4 is a schematic diagram illustrating a fin deployment mechanism according to an embodiment of the system described herein.

Referring to FIG. 4, the fin 26*b* is shown in a non-deployed position. The body 22 contains a deployment mechanism 62 having a gas generator 64 and a manifold 66. As described in more detail elsewhere herein, the manifold 66 has a separate outlet for each fin and each outlet is in fluid communication with the gas generator 64. As set forth below, each outlet may contain a piston that is acted upon by the gas from the generator 64 to push on and deploy all of the fins substantially simultaneously. The deployment mechanism 62 may be attached to the body 22 using any appropriate mechanism, including being bolted to the body through bolt holes (not shown) provided in the deployment mechanism 62.

In an embodiment herein, a padding element 68 is provided to cushion the force of the piston to prevent the piston from damaging the fin 26*b*. The padding element 68 may be made from a material that is somewhat softer than the material used for making the fin 26*b*. For example, the fin 26*b* (and all the other fins) may be made from 7075-T6 aluminum while the padding element 68 may be made from a somewhat softer 6061-T6 aluminum. Of course, other appropriate materials may be used for either the fins 26*a*, 26*b* and/or the padding element 68. Note that if the padding element 68 is too hard, the fins 26*a*, 26*b* may be damaged during deployment while if the padding element 68 is too soft, the padding element 68 may deform without the fins 26*a*, 26*b* being properly deployed.

Figure 5A:
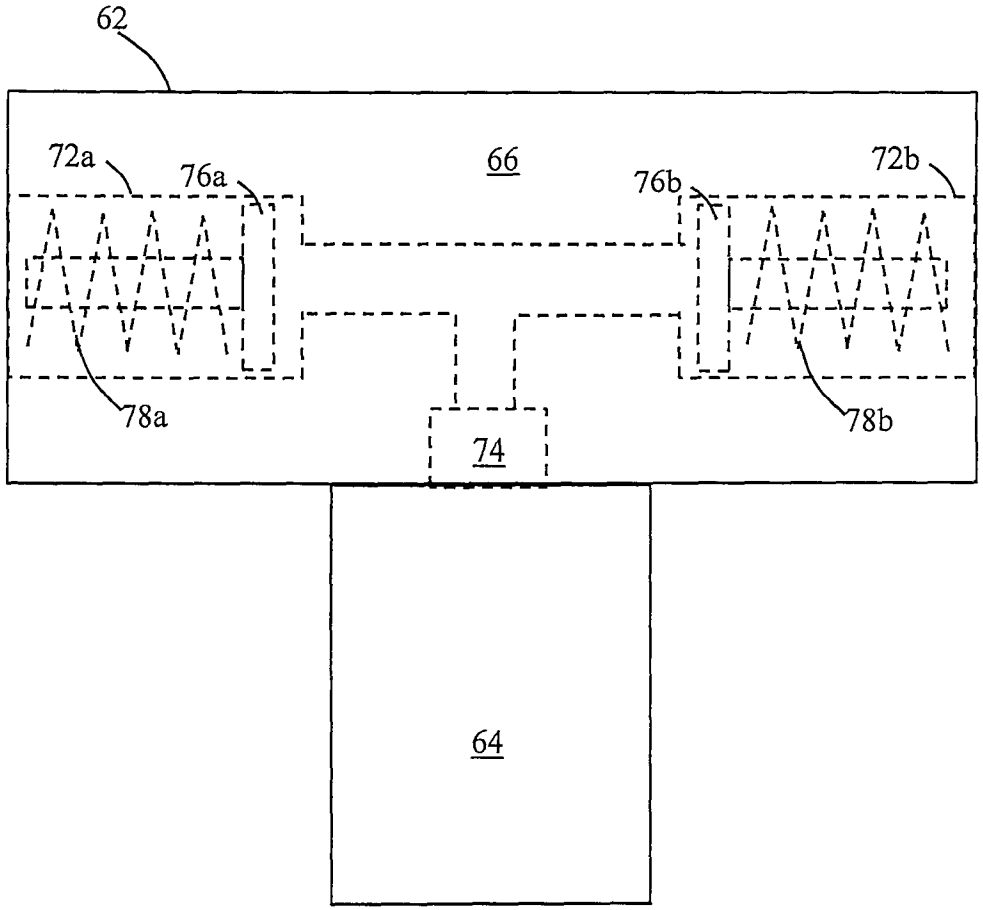
FIG. 5A is a schematic diagram illustrating in more detail a fin deployment mechanism according to an embodiment of the system described herein.

Referring to FIG. 5A, the deployment mechanism 62 is shown in more detail as including a plurality of cylinders 72*a*, 72*b* in fluid communication with the gas generator 64. Gas from the gas generator 64 may be released into the cylinders 72*a*, 72*b* in a rapid manner using an appropriate valve 74 that may be controlled externally by, for example, the electronics 34 shown in FIG. 1 and FIG. 2. Thus, all of the fins 26*a*, 26*b* may be deployed simultaneously by actuating the valve 74.

In an embodiment herein, the valve 74 may be actuated by the electronics 34 and/or by some other appropriate mechanism. Note that the electronics 34 may also separately handle actuation of the fins 26*a*, 26*b* for navigation. In other embodiments, a sensor may be used to detect when the system is being deployed (e.g., released from an aircraft in flight) and/or an external signal may be provided to indicate when the system is being deployed. In some embodiments, actuation of the valve 74 is sufficient to deploy the fins 26*a*, 26*b*. Note that the valve 74 may be implemented using a squib that is configured so that detonation of the squib causes the gas in the gas generator 64 to be rapidly released.

The cylinder 72*a* includes a piston 76*a* while the cylinder 72*b* includes a piston 76*b*. A top of each of the pistons 76*a*, 76*b* is acted upon by the gas from the gas generator 64 so that the bottom of each of the pistons 76*a*, 76*b* extends outward from the manifold 66 to deploy the fins 26*a*, 26*b*. In some embodiments, the bottoms of the pistons 76*a*, 76*b* may be coupled directly to the fins 26*a*, 26*b*. In other embodiments, the bottoms of the pistons 76*a*, 76*b* may be coupled to the fins 26*a*, 26*b* indirectly through the padding element 68, discussed above.

In an embodiment herein, the piston 76*a* may be provided with a spring 78*a* and the piston 76*b* may be provided with a spring 78*b*. The springs 78*a*, 78*b* may bias the pistons 76*a*, 76*b* in a direction opposite to the direction the pistons are pushed by gas from the gas generator 64. The springs 78*a*, 78*b* may facilitate providing an appropriate force to deploy the fins 26*a*, 26*b* and, in addition, may facilitate assembly of the system by retaining the pistons 76*a*, 76*b* within the manifold 66 during assembly.

Figure 5B:
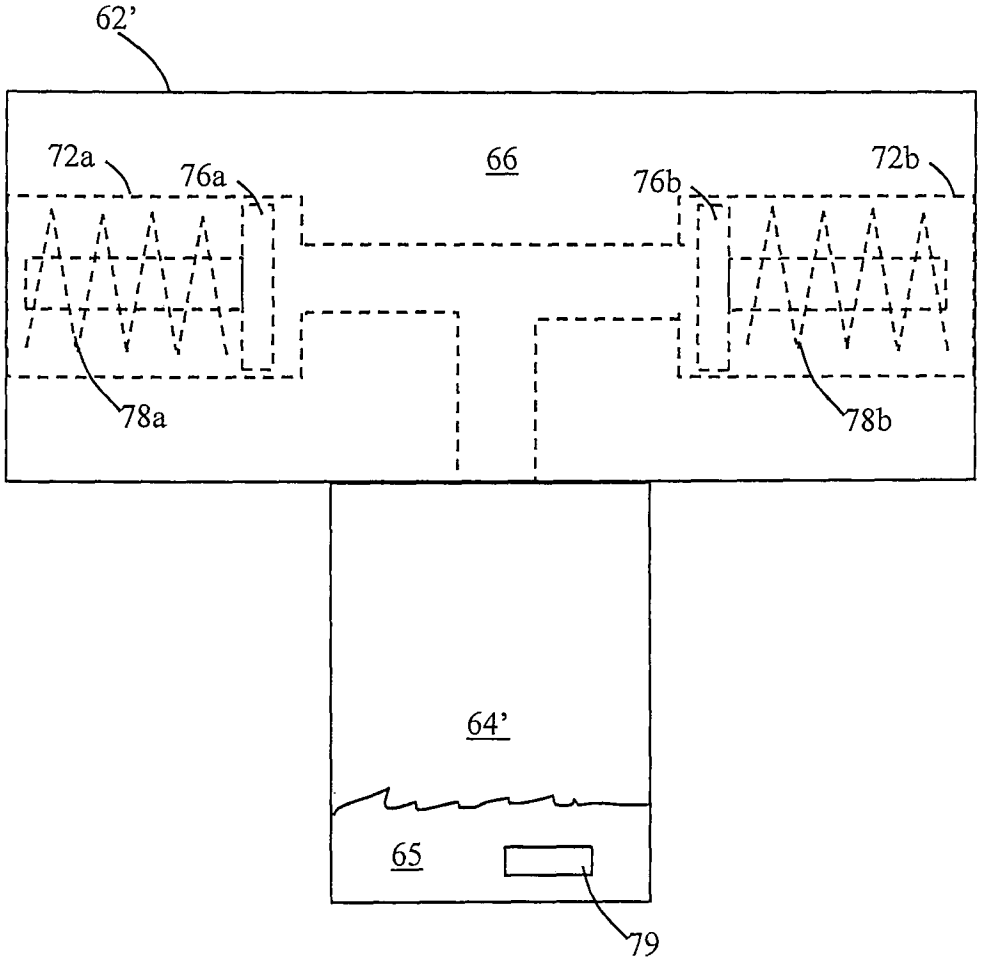
FIG. 5B is a schematic diagram illustrating in more detail an alternative fin deployment mechanism according to an embodiment of the system described herein.

Referring to FIG. 5B, an alternative deployment mechanism 62' is shown in detail as including the cylinders 72*a*, 72*b* in fluid communication with an alternative gas generator 64'. Just as with the deployment mechanism 62 of FIG. 5A, gas from the gas generator 64' may be released into the cylinders 72*a*, 72*b* in a rapid manner to deploy all of the fins 26*a*, 26*b* simultaneously. However, the alternative gas generator 64' may be implemented using a chemical initiator, such as that provided by Special Devices, Inc. of Newhall, Calif. under part no. 103377. The alternative gas generator 64' includes a reactive powder 65 that rapidly releases a significant amount of gas when ignited. The powder 65 may be ignited using an electrical resistive element/squib 79 that is coupled to and actuated by the electronics 34. Operation of the pistons 76*a*, 76*b* and springs 78*a*, 78*b* may be like that of the deployment mechanism 62 of FIG. 5A, described above.

Figure 6:
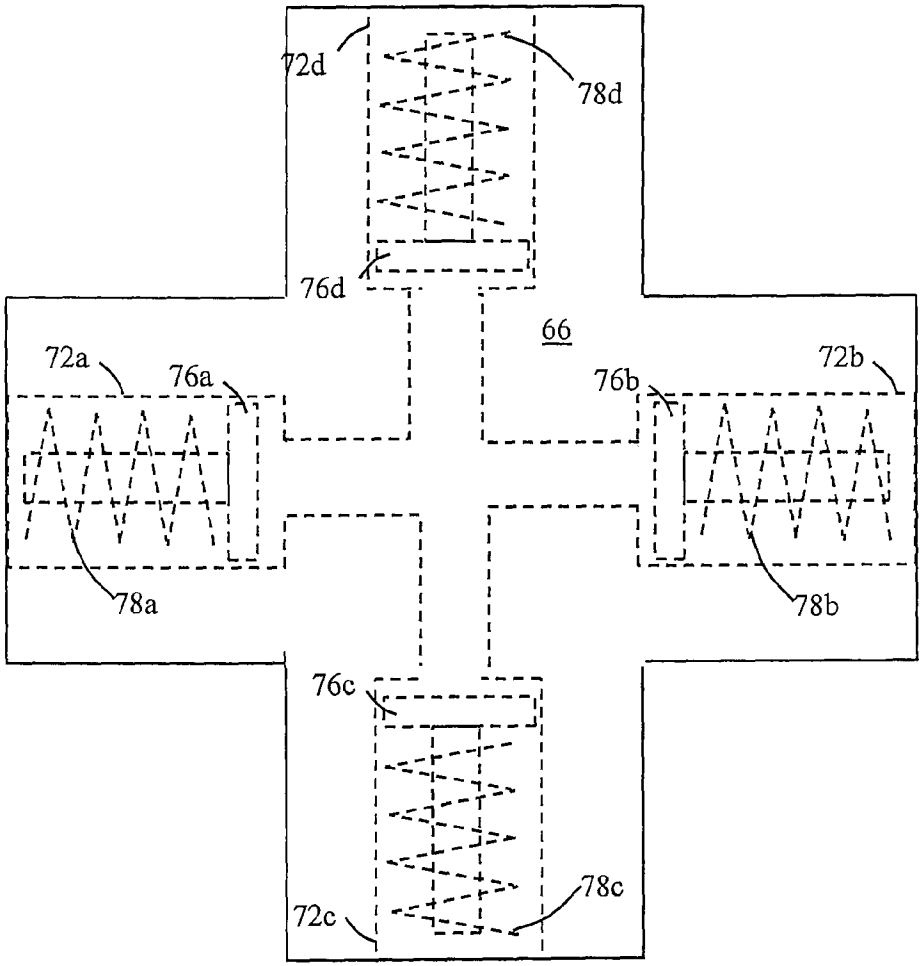
FIG. 6 is a schematic diagram illustrating a manifold of a gas deployment mechanism according to an embodiment of the system described herein.

Referring to FIG. 6, the manifold 66 is shown from a top view as including additional cylinders 72*c*, 72*d*, additional pistons 76*c*, 76*d*, and additional springs 78*c*, 78*d* which operate in a manner similar to that discussed above in connection with the cylinders 72*a*, 72*b*, pistons 76*a*, 76*b*, and springs 78*a*, 78*b*. In an embodiment herein, there are four fins that are deployed although, as discussed elsewhere herein, any number of fins may be used. All of the cylinders 72*a*-72*d* are in fluid communication with the gas generator 64 (not shown in FIG. 6). Thus, sufficient gas pressure causes the pistons 76*a*-76*d* to traverse the respective ones of the cylinders 72*a*-72*d* to deploy the corresponding fins more or less simultaneously.

Note that if the size (pressure) provided by the gas generator 64 (or the gas generator 64' or any other gas generator that is used) is too small, the fins 26*a*, 26*b* may not reliably deploy. On the other hand, if the size is too large, the fins 26*a*, 26*b* (and/or other components) may become damaged in connection with deployment. Accordingly, it may be desirable to determine a minimal size (pressure) for the gas generator and then choose a size that is a nominal percentage above the minimal size.

The amount of pressure, Pd, needed on the pistons 76*a*-76*d* to deploy the fins 26*a*, 26*b*, may be determined empirically. Similarly, the volume of the gas generator (e.g., the gas generator 64 or the gas generator 64'), the manifold 66, and the cylinders 72*a*-72*d* may also be determined. If V1 is the sum of the volumes of the gas generator, the manifold 66, and the cylinders 72*a*, 72*d*, and V2 is a reference volume used to test/spec the gas generator, then the following may be used to determine a minimum amount of pressure, Pg, for the gas generator at the reference volume V2:

$$Pg=(Pd*V2)/V1$$

For example, if it is determined that 4800 p.s.i. are needed to deploy the fins 26*a*, 26*b*, and if V1 is 2.5 CC and V2 is 10 CC, then the minimum pressure needed for the gas generator at the reference volume is 1200 p.s.i. This minimum may be then adjusted (increased) to account for expected variances in tolerance that could require more than 4800 p.s.i. to deploy the fins 26*a*, 26*b* and/or variances in actual values for V1 and V2. For example, 10% may be added to the calculated minimum pressure to provide an operating pressure of 1320 p.s.i. for the gas generator. The reference volume may be a volume used by the manufacturer/reseller to specify the capacity of the gas generator (e.g., delivers 1200 p.s.i. at 10 CC).

Note that the operating pressure for the gas generator should be present at a minimum operating temperature of the system (e.g., −65° F.) and that the equation above may be used to determine the maximum pressure on the pistons 76*a*-76*d* at a maximum operating temperature (e.g., +160° F.). In instances where the pressure on the pistons 76*a*-76*d* is determined to be too high at the maximum operating temperature, the system may be adjusted by, for example, changing the volume of the gas generator and then determining a new operating pressure for the gas generator.

Figure 7:
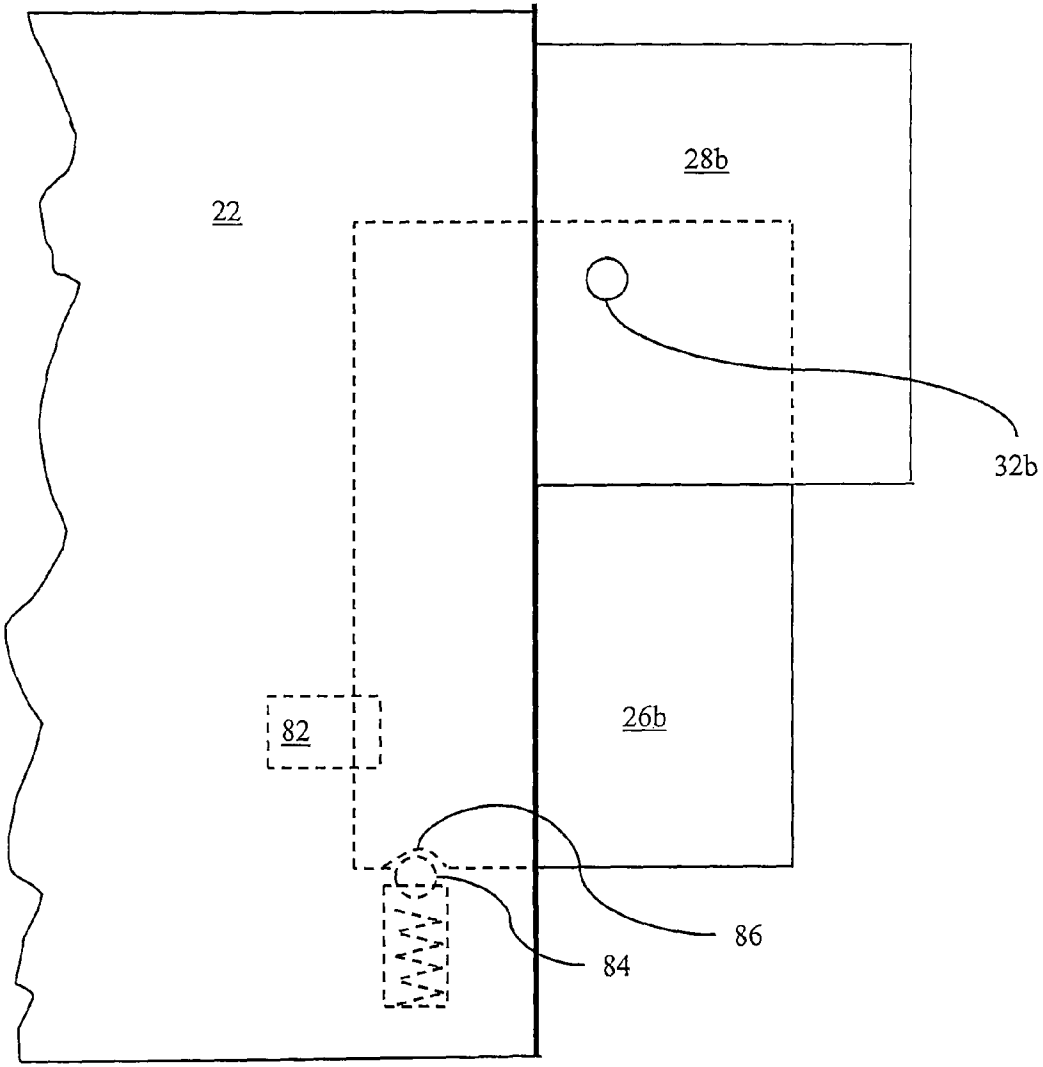
FIG. 7 is a schematic diagram illustrating additional fin retention mechanisms according to an embodiment of the system described herein.

Referring to FIG. 7, the fin 26*b* is shown in a non-deployed position as being retained by a second retaining mechanism that includes a spring clip 82 and a third retaining mechanism that includes a ball 84 and a detent 86 in the fin 26*b*, The ball 84 and the detent 86 may be like the ball 44 and the detent 42 discussed above. The spring clip 82 may be a metal deformable clip, as discussed in more detail elsewhere herein.

Figure 8:
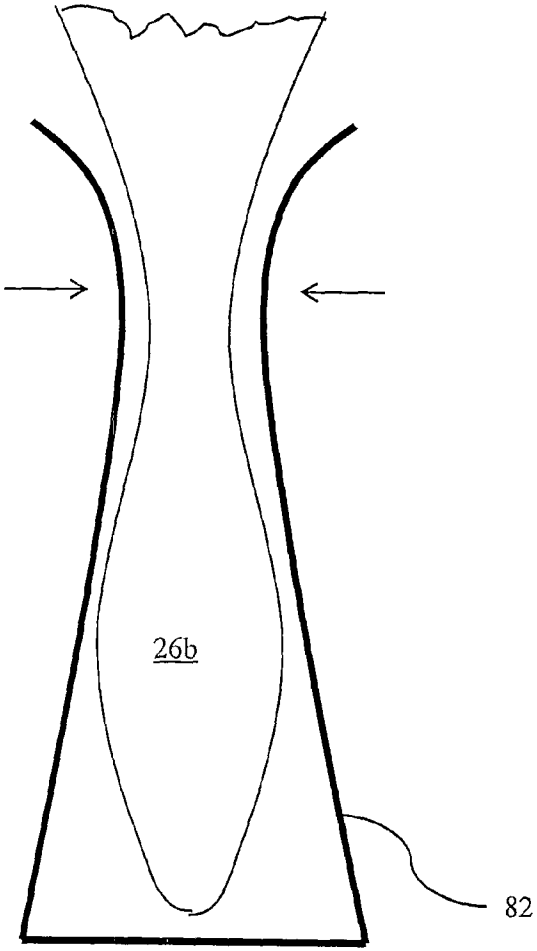
FIG. 8 is a schematic diagram illustrating a spring clip used for fin retention according to an embodiment of the system described herein.

Referring to FIG. 8, the spring clip 82 is shown in more detail in profile. The spring clip 82 exerts a force in a direction indicated by the arrows in FIG. 8 to retain an edge of the fin 26*b* that is shaped to be gripped by the spring clip 82. The spring clip 82 may retain the fin 26*b* in a non-deployed position until sufficient force is generated (e.g., by the deployment mechanism 62, discussed above) to pull the fin 26*b* away from the spring clip 82.

Figure 9:
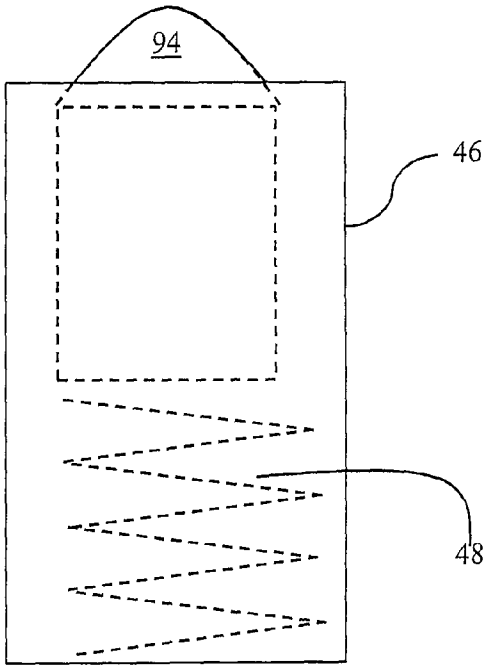
FIG. 9 is a schematic diagram illustrating a plunger used for fin retention according to an embodiment of the system described herein.

Referring to FIG. 9, an alternative implementation of the retaining mechanism of FIG. 3 is shown with the shaft 46 and the spring 48. However, instead of the ball 44 of FIG. 3, FIG. 9 shows a plunger 94 having a rounded end. The plunger 94 may be used instead of the ball 44 and/or instead of the ball 84 of FIG. 7. Note also that any or all of the retaining mechanisms illustrated herein may be used in any combination and/or eliminated so that, for example, it is possible to use only the retaining mechanism of FIG. 3, use the retaining mechanism of FIG. 3 in combination with the spring clip 82, use all of the retaining mechanisms described herein, etc.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A fin retention mechanism comprising:

a first detent in a fin;

a mechanism that engages the first detent;

at least one spring clip that maintains the fin in a non-deployed position; and a second detent in the fin that engages the mechanism when the first detent is not engaged;

wherein the fin is maintained in a deployed position in response to the second detent engaging with the mechanism and release of the fin from the spring clip.

2. A fin retention mechanism, according to claim 1, wherein the fin is maintained in a non-deployed position in response to the first detent engaging with the mechanism.

3. A fin retention mechanism, according to claim 1, wherein the mechanism that engages the first detent includes a ball and a spring that urges the ball toward the first detent.

4. A fin retention mechanism, according to claim 1, wherein the mechanism that engages the first detent includes a plunger and a spring that urges the plunger toward the first detent.

* * * * *